US008991479B2

(12) United States Patent
Fujii et al.

(10) Patent No.: US 8,991,479 B2
(45) Date of Patent: Mar. 31, 2015

(54) CONDENSER

(75) Inventors: Takayuki Fujii, Oyama (JP); Kazumi Tokizaki, Oyama (JP); Yoshihiko Seno, Oyama (JP); Shingo Suzuki, Oyama (JP)

(73) Assignee: Showa Denko K.K., Tokyo (JP)

( * ) Notice: Subject to any disclaimer, the term of this patent is extended or adjusted under 35 U.S.C. 154(b) by 1062 days.

(21) Appl. No.: 13/064,097

(22) Filed: Mar. 4, 2011

(65) Prior Publication Data

US 2011/0220335 A1 Sep. 15, 2011

(30) Foreign Application Priority Data

Mar. 10, 2010 (JP) ..... 2010-53025

(51) Int. Cl.

| | |
|---|---|
| ***F28B 7/00*** | (2006.01) |
| ***F25B 39/04*** | (2006.01) |
| ***F28D 1/04*** | (2006.01) |
| ***F28D 1/053*** | (2006.01) |
| *F28D 1/00* | (2006.01) |

(Continued)

(52) U.S. Cl.

CPC ..... *F25B 39/04* (2013.01); *F28D 1/0417* (2013.01); *F28D 1/05375* (2013.01); *F25B 2339/044* (2013.01); *F28D 2001/0266* (2013.01); *F28D 2001/0273* (2013.01); *F28D 2021/0084* (2013.01)

USPC ..... 165/110; 165/149; 165/176

(58) Field of Classification Search

CPC ..... F25B 39/04; F25B 2001/0266; F25B 2001/0273; F28D 1/047; F28D 1/0471; F28D 1/10475; F28D 1/0476; F28D 2021/0084

USPC ..... 165/110, 140, 149, 176; 62/478, 509

See application file for complete search history.

(56) References Cited

U.S. PATENT DOCUMENTS

| | | | | |
|---|---|---|---|---|
| 3,965,976 | A * | 6/1976 | Barton | 165/175 |
| 4,936,379 | A * | 6/1990 | Hoshino et al. | 165/150 |
| 5,988,267 | A * | 11/1999 | Park et al. | 165/110 |

(Continued)

FOREIGN PATENT DOCUMENTS

| | | |
|---|---|---|
| FR | 2747768 A1 | 10/1997 |
| JP | 3-31266 U | 3/1991 |

(Continued)

OTHER PUBLICATIONS

Office Action dated Jan. 7, 2014, issued for the corresponding Japanese patent application No. 2010-053025.

*Primary Examiner* — Tho V Duong

(74) *Attorney, Agent, or Firm* — Locke Lord LLP; James E. Armstrong, IV; George N. Chaclas

(57) ABSTRACT

A first header tank to which first heat exchange tubes of second and third heat exchange paths are connected and a second header tank to which second heat exchange tubes of a first heat exchange path are connected are provided at the left end of a condenser such that the former is located on the outer side of the latter with respect to a left-right direction and is offset from the latter in an air passage direction. The upper end of the first header tank is located above the lower end of the second header tank. The first header tank has a function of separating gas and liquid and storing the liquid. The first and second heat exchange tubes and side plates are bent in the same direction about a common vertical line. This condenser is suitable for use in a car air conditioner mounted on an automobile.

6 Claims, 5 Drawing Sheets

(51) Int. Cl.
*F28D 1/02* (2006.01)
*F28D 21/00* (2006.01)

(56) References Cited

U.S. PATENT DOCUMENTS

| | | | | |
|---|---|---|---|---|
| 2005/0247439 | A1* | 11/2005 | Wada et al. | 165/132 |
| 2007/0169922 | A1* | 7/2007 | Pautler | 165/153 |
| 2007/0204978 | A1* | 9/2007 | Beamer | 165/124 |
| 2008/0115528 | A1 | 5/2008 | Yamamoto et al. | |

FOREIGN PATENT DOCUMENTS

| | | | | |
|---|---|---|---|---|
| JP | 03-087572 | A | | 4/1991 |
| JP | 04116385 | A | * | 4/1992 |
| JP | 04-174298 | A | | 6/1992 |
| JP | 04-340094 | A | | 11/1992 |
| JP | 07-35949 | A | | 7/1995 |
| JP | 2002-205535 | A | | 7/2002 |
| JP | 2008-126720 | A | | 6/2008 |
| WO | WO-2007/074796 | A1 | | 7/2007 |

* cited by examiner

CONDENSER

BACKGROUND OF THE INVENTION

The present invention relates to a condenser suitable for use in, for example, a car air conditioner mounted on an automobile.

Herein and in the appended claims, the term "condenser" encompasses not only ordinary condensers but also sub-cool condensers each including a condensation section and a super-cooling section.

Further, herein and in the appended claims, the upper side, lower side, left-hand side, and right-hand side of FIGS. 1 and 2 will be referred to as "upper," "lower," "left," and "right," respectively.

A condenser for a car air conditioner is known (see Japanese Utility Model Application Laid-Open (kokai) No. H3-31266). The known condenser includes a plurality of heat exchange tubes disposed in parallel such that they are spaced apart from one another in a vertical direction; and header tanks which extend in the vertical direction and to which left and right end portions of the heat exchange tubes are connected, respectively. Three heat exchange paths each formed by a plurality of heat exchange tubes successively arranged in the vertical direction are provided such that the three heat exchange paths are juxtaposed in the vertical direction. Refrigerant flows in the same direction through all the heat exchange tubes which form each heat exchange path, and the flow direction of refrigerant flowing through the heat exchange tubes which form one of two adjacent heat exchange paths is opposite the flow direction of refrigerant flowing through the heat exchange tubes which form the other heat exchange path. A first header tank and a second header tank are individually provided at the left end or right end. The heat exchange tubes which form the heat exchange path at the lower end are connected to the first header tank. The heat exchange tubes which form the heat exchange paths other than the lower end heat exchange path are connected to the second header tank. The second header tank is disposed above the first header tank. The thickness (diameter) of the first header tank is rendered considerably larger than that of the second header tank, and a desiccant is disposed within the first header tank. Thus, the first header tank functions as a liquid receiver which separates gas and liquid from each other by making use of gravitational force and stores the separated liquid. The first heat exchange tubes connected to the first header tank are equal in length to the second heat exchange tubes connected to the second header tank, and the ends of the first heat exchange tubes on the side toward the first header tank and the ends of the second heat exchange tubes on the side toward the second header tank are located on the same vertical line. All the heat exchange paths serve as refrigerant condensation paths for condensing refrigerant.

In the condenser disclosed in the publication, the internal volume of the first header tank must be rendered considerably large as compared with that of the second header tank, in order to effectively perform gas liquid separation within the first header tank. Therefore, the thickness of the first header tank is considerably large as compared with the second header tank, which raises a problem in that a large space is required for installing the condenser.

In general, other devices are disposed in the vicinity of a condenser. In the case of the condenser disclosed in the publication, the first header tank hinders installation of other devices. For example, a radiator is typically disposed downstream (with respect to an air passage direction) of a condenser for a car air conditioner. If the condenser disclosed in the publication is used, the first header tank hinders installation of the radiator. As a result, a wasteful space is produced within an engine compartment, which makes space saving difficult. In addition, since the heat exchange tubes are connected over substantially the entire length of the first header tank, the conventional condenser has a problem in that its gas liquid separation performance is not satisfactory.

SUMMARY OF THE INVENTION

An object of the present invention is to solve the above-mentioned problem and to provide a condenser which is less likely to hinder installation of other devices in the vicinity thereof, as compared with the condenser disclosed in the above-mentioned publication.

To achieve the above object, the present invention comprises the following modes.

1) A condenser comprising a plurality of heat exchange tubes disposed in parallel such that the heat exchange tubes are spaced apart from one another in a vertical direction and extend in a left-right direction; header tanks which extend in the vertical direction and to which left and right end portions of the heat exchange tubes are connected; and fins each disposed between heat exchange tubes adjacent to each other in the vertical direction, in which three or more heat exchange paths each formed by a plurality of heat exchange tubes successively arranged in the vertical direction are juxtaposed in the vertical direction, refrigerant flows in the same direction in all the heat exchange tubes which form each heat exchange path, and the flow direction of refrigerant in the heat exchange tubes which form a certain heat exchange path is opposite the flow direction of refrigerant in the heat exchange tubes which form another heat exchange path adjacent to the certain heat exchange path, wherein first and second header tanks are provided at a left or right end of the condenser, first heat exchange tubes which form at least two heat exchange paths successively arranged and including a heat exchange path at a lower end of the condenser being connected to the first header tank, and second heat exchange tubes which form a heat exchange path(s) provided above the heat exchange paths formed by the first heat exchange tubes connected to the first header tank being connected to the second header tank;

the first header tank is disposed on the outer side of the second header tank with respect to the left-right direction, has an upper end located above a lower end of the second header tank, and has a function of separating gas and liquid from each other by making use of gravitational force and storing the liquid;

the first header tank is disposed at a position offset from the second header tank with respect to an air passage direction as viewed from above; and the first heat exchange tubes connected to the first header tank and the second heat exchange tubes connected to the second header tank are bent in the same direction about a common vertical line.

2) A condenser according to par. 1), wherein an upper end heat exchange path of the heat exchange paths formed by the first heat exchange tubes connected to the first header tank and the heat exchange path(s) formed by the second heat exchange tubes connected to the second header each serve as a refrigerant condensation path for condensing refrigerant, and the heat exchange paths formed by the first heat exchange tubes connected to the first header tank, excluding the upper end heat exchange path, each serves as a refrigerant supper-cooling path for supper-cooling refrigerant.

3) A condenser according to par. 1), wherein the first heat exchange tubes which form at least two heat exchange paths are connected to the first header tank, and the second heat exchange tubes which form at least one heat exchange path are connected to the second header tank.

4) A condenser comprising a plurality of heat exchange tubes disposed in parallel such that the heat exchange tubes are spaced apart from one another in a vertical direction and extend in a left-right direction; header tanks which extend in the vertical direction and to which left and right end portions of the heat exchange tubes are connected; and fins each disposed between heat exchange tubes adjacent to each other in the vertical direction, in which two or more heat exchange paths each formed by a plurality of heat exchange tubes successively arranged in the vertical direction are juxtaposed in the vertical direction, refrigerant flows in the same direction in all the heat exchange tubes which form each heat exchange path, and the flow direction of refrigerant in the heat exchange tubes which form a certain heat exchange path is opposite the flow direction of refrigerant in the heat exchange tubes which form another heat exchange path adjacent to the certain heat exchange path, wherein first and second header tanks are provided at a left or right end of the condenser, first heat exchange tubes which form a heat exchange path at a lower end of the condenser being connected to the first header tank, and second heat exchange tubes which form the remaining heat exchange path(s) being connected to the second header tank;

the first header tank is disposed on the outer side of the second header tank with respect to the left-right direction, has an upper end located above a lower end of the second header tank, and has a function of separating gas and liquid from each other by making use of gravitational force and storing the liquid;

the first header tank is disposed at a position offset from the second header tank with respect to an air passage direction as viewed from above; and the first heat exchange tubes connected to the first header tank and the second heat exchange tubes connected to the second header tank are bent in the same direction about a common vertical line.

5) A condenser comprising a plurality of heat exchange tubes disposed in parallel such that the heat exchange tubes are spaced apart from one another in a vertical direction and extend in a left-right direction; header tanks which extend in the vertical direction and to which left and right end portions of the heat exchange tubes are connected; and fins each disposed between heat exchange tubes adjacent to each other in the vertical direction, in which two or more heat exchange paths each formed by a plurality of heat exchange tubes successively arranged in the vertical direction are juxtaposed in the vertical direction, refrigerant flows in the same direction in all the heat exchange tubes which form each heat exchange path, and the flow direction of refrigerant in the heat exchange tubes which form a certain heat exchange path is opposite the flow direction of refrigerant in the heat exchange tubes which form another heat exchange path adjacent to the certain heat exchange path, wherein first and second header tanks are provided at a left or right end of the condenser, first heat exchange tubes which form a heat exchange path at an upper end of the condenser being connected to the first header tank, and second heat exchange tubes which form the remaining heat exchange path(s) being connected to the second header tank;

the first header tank is disposed on the outer side of the second header tank with respect to the left-right direction, has a lower end located below an upper end of the second header tank, and has a function of separating gas and liquid from each other by making use of gravitational force and storing the liquid;

the first header tank is disposed at a position offset from the second header tank with respect to an air passage direction as viewed from above; and the first heat exchange tubes connected to the first header tank and the second heat exchange tubes connected to the second header tank are bent in the same direction about a common vertical line.

6) A condenser according to par. 4) or 5), wherein each of all the heat exchange paths serves as a refrigerant condensation path for condensing refrigerant.

7) A condenser according to par. 1), 4) or 5), wherein a fin is disposed on the outer side of each of the heat exchange tubes located at the upper and lower ends and is brazed to the corresponding heat exchange tube, a side plate is disposed on the outer side of each of the fins located at the upper and lower ends and is brazed to the corresponding fin, and the side plates are bent in the same direction as the first and second heat exchange tubes about the common vertical line about which the first and second heat exchange tubes are bent.

8) A condenser according to par. 7), wherein a cutout which opens toward a direction opposite the bending direction of the side plates is formed in each side plate at a position near the end thereof located toward the first and second header tanks, and the vertical line about which the first and second heat exchange tubes and the side plates are bent is located within the cutouts of the side plates.

9) A method for manufacturing a condenser according to par. 1), 4) or 5), characterized in that, after the first header tank, the second header tank, the first heat exchange tubes, the second heat exchange tubes, and the fins are brazed together, the first heat exchange tubes connected to the first header tank and the second heat exchange tubes connected to the second header tank are bent in the same direction about the common vertical line.

10) A method for manufacturing a condenser according to par. 7), characterized in that, after the first header tank, the second header tank, the first heat exchange tubes, the second heat exchange tubes, the fins, and the side plates are brazed together, the first heat exchange tubes connected to the first header tank, the second heat exchange tubes connected to the second header tank, and the side plates are bent in the same direction about the common vertical line.

11) A method for manufacturing a condenser according to par. 8), characterized in that a cutout which opens toward a direction opposite a direction in which the side plates are to be bent is formed in each side plate at a position near the end thereof which is to be connected to the first or second header tank; and, after the first header tank, the second header tank, the first heat exchange tubes, the second heat exchange tubes, the fins, and the side plates are brazed together, the first heat exchange tubes connected to the first header tank, the second heat exchange tubes connected to the second header tank, and the side plates are bent, about a common vertical line located within the cutouts of the side plates, in a direction opposite the direction toward which the openings of the side plates open.

According to the condenser of any one of pars. 1) to 4), first and second header tanks are provided at the left or right end of the condenser. First heat exchange tubes which form at least two heat exchange paths successively arranged and including a heat exchange path at the lower end are connected to the first header tank, and second heat exchange tubes which form a heat exchange path(s) provided above the heat exchange paths formed by the first heat exchange tubes connected to the first header tank are connected to the second header tank. The first header tank is disposed on the outer side of the second header tank with respect to the left-right direction, has an upper end located above a lower end of the second header tank, and has a function of separating gas and liquid from each other by making use of gravitational force and storing the liquid. The first header tank is disposed at a position offset from the second header tank with respect to the air passage direction as viewed from above. The first heat exchange tubes connected to the first header tank and the second heat exchange tubes connected to the second header tank are bent in the same direction about a common vertical line. Therefore, as compared with the condenser disclosed in the above-mentioned publication, the internal volume of the first header tank can be increased so as to effectively perform gas liquid separation, for example, by extending the upper end of the first header tank upward to the vicinity of the upper end of the second header tank, without making the thickness of the first header tank greater than that of the second header tank. Accordingly, a space for installing the condenser can be made smaller as compared with the condenser disclosed in the above-mentioned publication. In particular, even in the case where a radiator is disposed on the downstream side (with respect to the air passage direction) of a condenser for a car air conditioner, the first header tank does not hinder installation of the radiator, and a wasteful space is not produced within an engine compartment, because the first header tank is disposed on the outer side of the second header tank with respect to the left-right direction at a position offset in the air passage direction, and the first heat exchange tubes connected to the first header tank and the second heat exchange tubes connected to the second header tank are bent in the same direction about a common vertical line. As a result, space saving becomes possible. In addition, since a relatively large space is present above a portion of the first header tank to which heat exchange tubes are connected, the gas liquid separation action by gravitational force becomes excellent.

According to the condenser of par. 2), refrigerant flows into the first header tank from a plurality of heat exchange tubes which form the refrigerant condensation path located at the lower end, and gas liquid separation is performed within the first header tank. Therefore, it is possible to suppress a drop in pressure, to thereby prevent re-vaporization of liquid-phase refrigerant.

Further, according to the condenser of par. 2), refrigerant flows into the first header tank from a plurality of heat exchange tubes which form the refrigerant condensation path located at the lower end, and gas liquid separation is performed within the first header tank. Therefore, the gas liquid separation can be performed efficiently within the first header tank. That is, gas-liquid mixed phase refrigerant whose gas phase component is large in amount flows through upper-side heat exchange tubes among a plurality of heat exchange tubes which form a refrigerant condensation path, and gas-liquid mixed phase refrigerant whose liquid phase component is large in amount flows through lower-side heat exchange tubes among the plurality of heat exchange tubes. Since these gas-liquid mixed phase refrigerants flow into the first header tank without mixing, gas liquid separation can be performed efficiently.

According to the condenser of par. 5), first and second header tanks are provided at the left or right end of the condenser. First heat exchange tubes which form a heat exchange path at the upper end of the condenser are connected to the first header tank, and second heat exchange tubes which form the remaining heat exchange path(s) are connected to the second header tank. The first header tank is disposed on the outer side of the second header tank with respect to the left-right direction, has a lower end located below an upper end of the second header tank, and has a function of separating gas and liquid from each other by making use of gravitational force and storing the liquid. The first header tank is disposed at a position offset from the second header tank with respect to an air passage direction as viewed from above. The first heat exchange tubes connected to the first header tank and the second heat exchange tubes connected to the second header tank are bent in the same direction about a common vertical line. Therefore, refrigerant flows into the first header tank from a plurality of heat exchange tubes which form the heat exchange path located at the upper end, and gas liquid separation is performed within the first header tank. Accordingly, the gas liquid separation can be performed efficiently within the first header tank. That is, gas-liquid mixed phase refrigerant whose gas phase component is large in amount flows through upper-side first heat exchange tubes among the plurality of first heat exchange tubes which form the upper end heart exchange path, and gas-liquid mixed phase refrigerant whose liquid phase component is large in amount flows through lower-side first heat exchange tubes among the plurality of first heat exchange tubes. Since these gas-liquid mixed phase refrigerants flow into the first header tank without mixing, gas liquid separation can be performed efficiently. Moreover, as compared with the condenser disclosed in the above-mentioned publication, the internal volume of the first header tank can be increased so as to effectively perform gas liquid separation, for example, by extending the lower end of the first header tank downward to the vicinity of the lower end of the second header tank, without making the thickness of the first header tank greater than that of the second header tank. Accordingly, a space for installing the condenser can be made smaller as compared with the condenser disclosed in the above-mentioned publication. In particular, even in the case where a radiator is disposed on the downstream side (with respect to the air passage direction) of a condenser for a car air conditioner, the first header tank does not hinder installation of the radiator, and a wasteful space is not produced within an engine compartment, because the first header tank is disposed on the outer side of the second header tank with respect to the left-right direction, and the first heat exchange tubes connected to the first header tank and the second heat exchange tubes connected to the second header tank are bent in the same direction about a common vertical line. As a result, space saving becomes possible. In addition, since a space is present above a portion of the first header tank to which heat exchange tubes are connected, the gas liquid separation action by gravitational force becomes excellent.

The condenser according to any one of pars. 1), 4), and 5) may be manufactured by the method of par. 9) in which, after the first header tank, the second header tank, the first heat exchange tubes, the second heat exchange tubes, and the fins are brazed together, the first heat exchange tubes connected to the first header tank and the second heat exchange tubes connected to the second header tank are bent in the same direction about the common vertical line. In this case, temporary assembly of the header tanks, the heat exchange tubes, and the fins can be performed simply, as compared with the case where the first heat exchange tubes and the second heat exchange tubes are bent before brazing of the first header tank, the second header tank, the first heat exchange tubes, the second heat exchange tubes, and the fins.

The condenser according to par. 7) may be manufactured by the method of par. 10) in which, after the first header tank, the second header tank, the first heat exchange tubes, the second heat exchange tubes, the fins, and the side plates are brazed together, the first heat exchange tubes connected to the first header tank, the second heat exchange tubes connected to the second header tank, and the side plates are bent in the same direction about the common vertical line. In this case, temporary assembly of the header tanks, the heat exchange tubes, the fins, and the side plates can be performed simply, as compared with the case where the first heat exchange tubes, the second heat exchange tubes, and the side plates are bent before brazing of the first header tank, the second header tank, the first heat exchange tubes, the second heat exchange tubes, the fins, and the side plates.

The condenser according to par. 8) may be manufactured by the method of par. 11) in which a cutout which opens toward a direction opposite a direction in which the side plates are to be bent is formed in each side plate at a position near the end thereof to be connected to the first or second header tank; and, after the first header tank, the second header tank, the first heat exchange tubes, the second heat exchange tubes, the fins, and the side plates are brazed together, the first heat exchange tubes connected to the first header tank, the second heat exchange tubes connected to the second header tank, and the side plates are bent, about a common vertical line located within the cutouts of the side plates, in a direction opposite the direction toward which the openings of the side plates open. In this case, temporary assembly of the header tanks, the heat exchange tubes, the fins, and the side plates can be performed simply, as compared with the case where the first heat exchange tubes, the second heat exchange tubes, and the side plates are bent before brazing of the first header tank, the second header tank, the first heat exchange tubes, the second heat exchange tubes, the fins, and the side plates. In addition, after the first header tank, the second header tank, the first heat exchange tubes, the second heat exchange tubes, the fins, and the side plates are brazed together, the first heat exchange tubes, the second heat exchange tubes, and the side plates are bent in the same direction about the common vertical line located within the cutouts of the side plates. Therefore, the fins brazed to the side plates are prevented from deforming greatly.

According to the method for manufacturing a condenser of par. 9), temporary assembly of the header tanks, the heat exchange tubes, and the fins can be performed simply, as compared with the case where the first heat exchange tubes and the second heat exchange tubes are bent before brazing of the first header tank, the second header tank, the first heat exchange tubes, the second heat exchange tubes, and the fins.

According to the method for manufacturing a condenser of par. 10), temporary assembly of the header tanks, the heat exchange tubes, the fins, and the side plates can be performed simply, as compared with the case where the first heat exchange tubes, the second heat exchange tubes, and the side plates are bent before brazing of the first header tank, the second header tank, the first heat exchange tubes, the second heat exchange tubes, the fins, and the side plates.

According to the method for manufacturing a condenser of par. 11), temporary assembly of the header tanks, the heat exchange tubes, the fins, and the side plates can be performed simply, as compared with the case where the first heat exchange tubes, the second heat exchange tubes, and the side plates are bent before brazing of the first header tank, the second header tank, the first heat exchange tubes, the second heat exchange tubes, the fins, and the side plates. In addition, after the first header tank, the second header tank, the first heat exchange tubes, the second heat exchange tubes, the fins, and the side plates are brazed together, the first heat exchange tubes, the second heat exchange tubes, and the side plates are bent in the same direction about the common vertical line located within the cutouts of the side plates. Therefore, the fins brazed to the side plates are prevented from deforming greatly.

DESCRIPTION OF THE PREFERRED EMBODIMENTS

Embodiments of the present invention will next be described with reference to the drawings.

Figure 1:
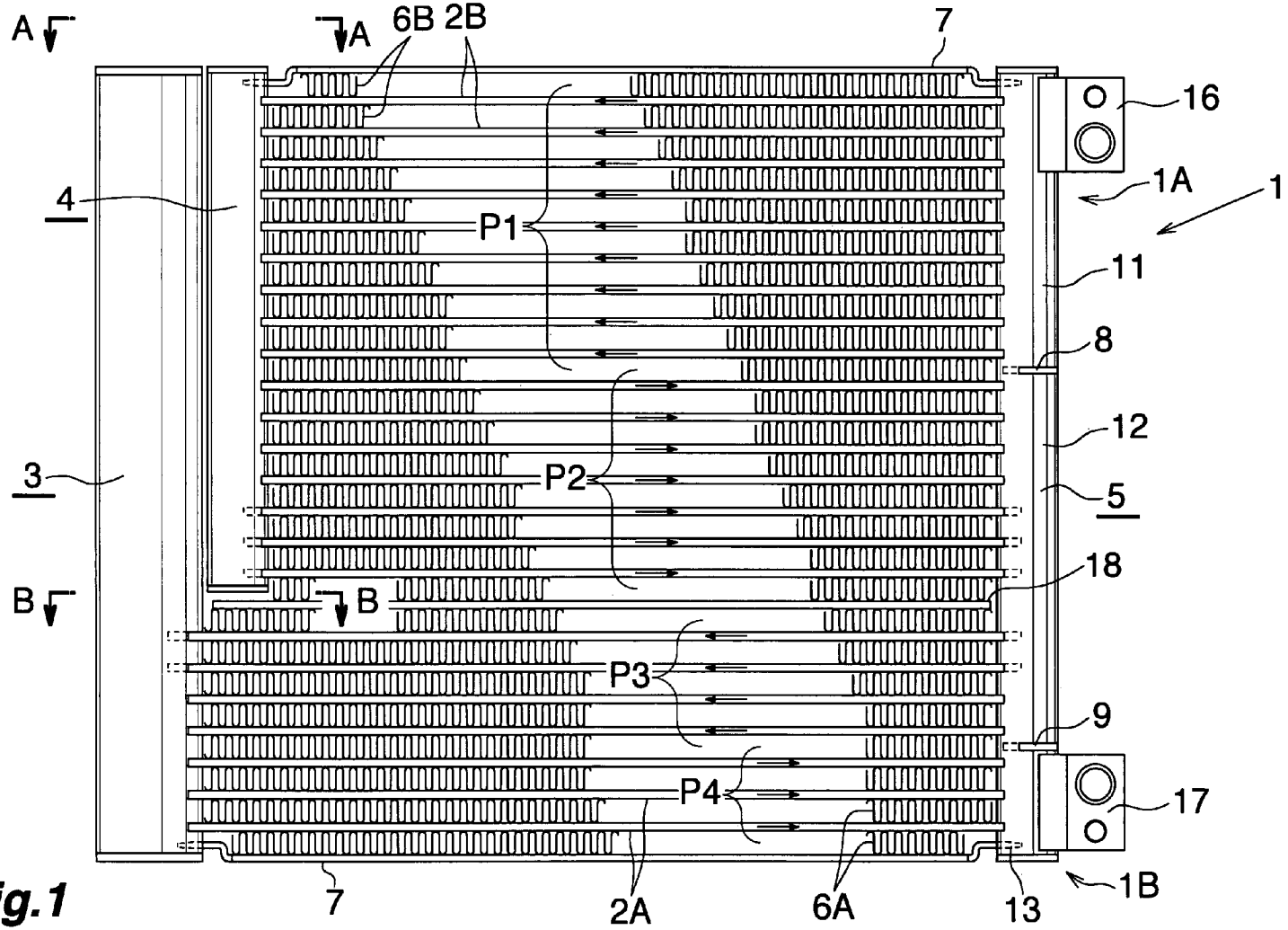
FIG. 1 is a front view specifically showing the overall structure of a first embodiment of the condenser according to the present invention.

In the following description, the downstream side with respect to an air passage direction (the reverse side of a sheet on which FIG. 1 is drawn; the upper side in FIGS. 3 and 4) will be referred to as the "front," and the opposite side as the "rear."

Furthermore, the term "aluminum" as used in the following description encompasses aluminum alloys in addition to pure aluminum.

Moreover, the same reference numerals are used throughout the drawings to refer to the same portions and members, and their repeated descriptions are omitted.

Figure 2:
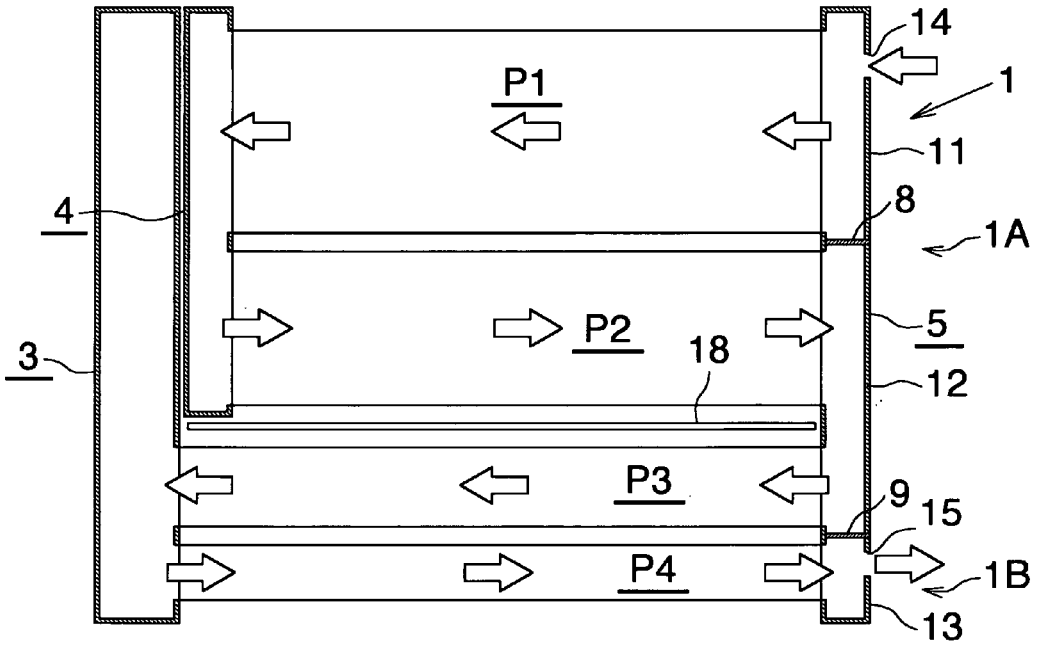
FIG. 2 is a front view schematically showing the condenser of FIG. 1.
Figure 3:
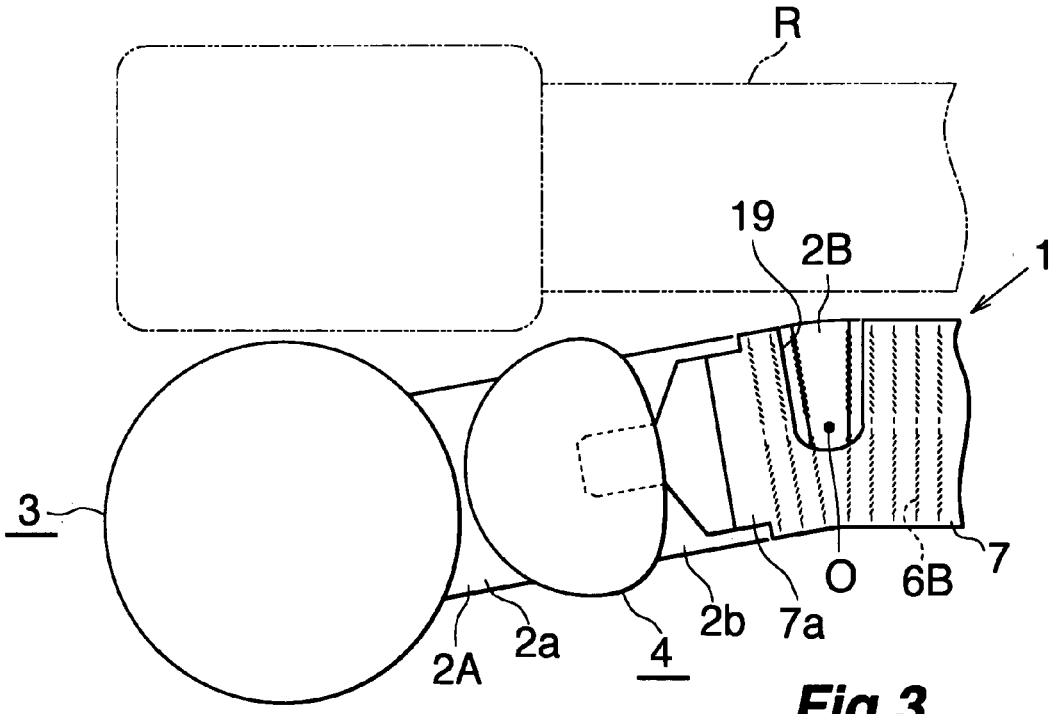
FIG. 3 is an enlarged top view of a portion indicated by arrowed line A-A, of FIG. 1.
Figure 4:
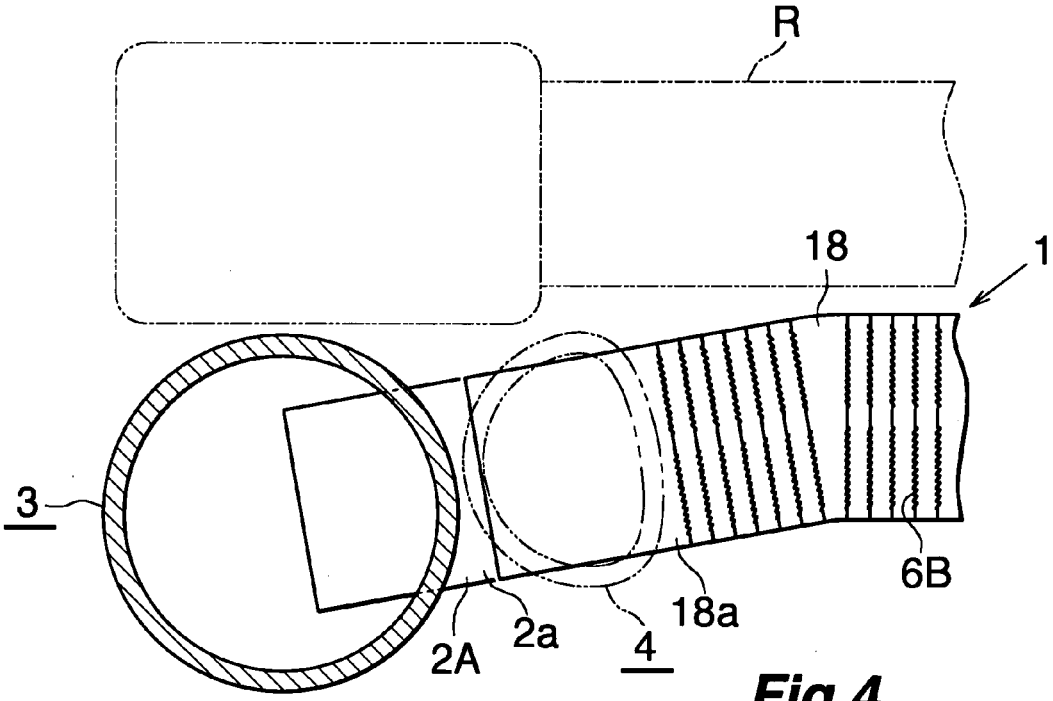
FIG. 4 is an enlarged sectional view taken along line B-B of FIG. 1.
Figure 5:
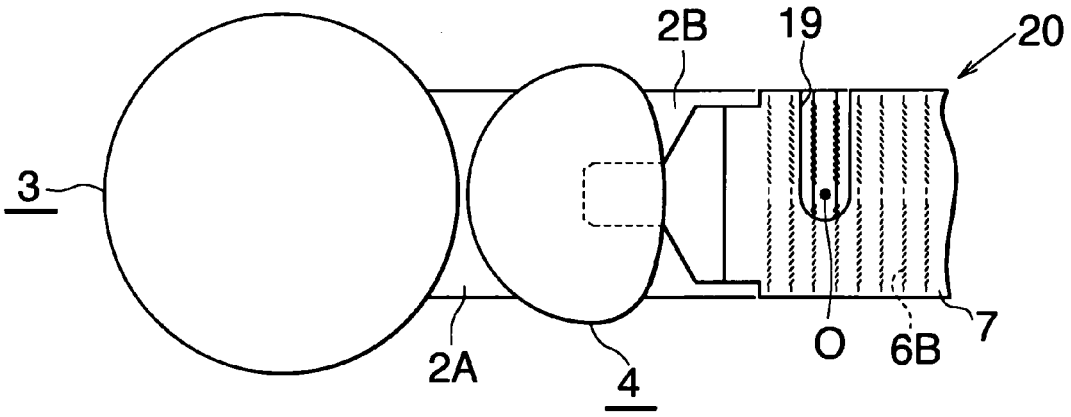
FIG. 5 is a view corresponding to FIG. 3 and showing a step of a method for manufacturing the condenser of FIG. 1.

FIG. 1 specifically shows the overall structure of a condenser according to the present invention; and FIG. 2 schematically shows the condenser according to the present invention. In FIG. 2, individual heat exchange tubes are omitted, and corrugate fins, side plates, a refrigerant inlet member, and a refrigerant outlet member are also omitted. FIGS. 3 and 4 show the structure of a main portion of the condenser of FIG. 1, and FIG. 5 shows a step of a method for manufacturing the condenser of FIG. 1.

In FIG. 1, a condenser 1 includes a plurality of flat heat exchange tubes 2A, 2B formed of aluminum, three header tanks 3, 4, 5 formed of aluminum, corrugate fins 6A, 6B formed of aluminum, and side plates 7 formed of aluminum. The heat exchange tubes 2A, 2B are disposed such that their width direction coincides with a front-rear direction, their length direction coincides with a left-right direction, and they are spaced from one another in a vertical direction. Left and right end portions of the heat exchange tubes 2A, 2B are connected, by means of brazing, to the header tanks 3, 4, 5, which extend in the vertical direction. Each of the corrugate fins 6A, 6B is disposed between and brazed to adjacent heat exchange tubes 2A, 2B, or is disposed on the outer side of the uppermost or lowermost heat exchange tube 2A, 28 and brazed to the corresponding heat exchange tube 2A, 2B. The side plates 7 are disposed on the corresponding outer sides of the uppermost and lowermost corrugate fins 6A, 6B, and are brazed to these corrugate fins 6A, 6B. Three or more heat exchange paths (in the present embodiment, four heat exchange paths P1, P2, P3, P4) each formed by a plurality of heat exchange tubes 2A, 2B successively arranged in the vertical direction are juxtaposed in the vertical direction. The four heat exchange paths will be referred to as the first to fourth heat exchange paths P1, P2, P3, P4 from the upper side. The flow direction of refrigerant is the same among all the heat exchange tubes 2A, 2B which form the respective heat exchange paths P1, P2, P3, P4. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path. Left and right end portions of the heat exchange tubes 2A, 2B are brazed to the header tanks 3, 4, 5 in a state in which the left and right end portions are inserted into tube insertion holes formed in the header tanks 3, 4, 5.

As shown in FIGS. 1 and 2, a first header tank 3 and a second header tank 4 are individually provided at the left end of the condenser 1. The heat exchange tubes 2A, which form at least two heat exchange paths which are successively arranged and which include a heat exchange path at the lower end (in the present embodiment, the third and fourth heat exchange paths. P3, P4) are connected to the first header tank 3 by means of brazing. The heat exchange tubes 2B, which form the first and second heat exchange paths P1, P2, are connected to the second header tank 4 by means of brazing. The heat exchange tubes 2A connected to the first header tank 3 will be referred to as the first heat exchange tubes, and the heat exchange tubes 2B connected to the second header tank 4 will be referred to as the second heat exchange tubes. The corrugate fins 6A disposed between the adjacent first heat exchange tubes 2A and between the lower end first heat exchange tube 2A and the lower side plate 7 will be referred to as the first corrugate fins, and the corrugate fins 6B disposed between the adjacent second heat exchange tubes 2B and between the upper end second heat exchange tube 2B and the upper side plate 7 will be referred to as the second corrugate fins.

Although the first header tank 3 and the second header tank 4 are approximately equal to each other in terms of the dimension along the front-rear direction, the first header tank 3 is greater than the second header tank 4 in terms of the horizontal cross sectional area. The first header tank 3 is disposed on the left side (on the outer side with respect to the left-right direction) of the second header tank 4. The center of the first header tank 3 with respect to the left-right direction is located on the outer side (with respect to the left-right direction) of the center of the second header tank 4 with respect to the left-right direction, and the center of the first header tank 3 with respect to the front-rear direction is located on the upstream side (with respect to the air passage direction) (rear side) of the center of the second header tank 4 with respect to the front-rear direction. Therefore, the first header tank 3 is disposed at a position which is on the outer side of the second header tank 4 with respect to the left-right direction and offset in the air passage direction, and the first header tank 3 and the second header tank 4 are offset from each other such that they do not overlap as viewed from above. The upper end of the first header tank 3 is located above the lower end of the second header tank 4. In the present embodiment, the upper end of the first header tank 3 is located at a position which is substantially the same height as the upper end of the second header tank 4. Thus, the first header tank 3 serves as a liquid receiver which separates gas and liquid from each other through utilization of gravitational force, and stores the separated liquid. That is, the internal volume of the first header tank 3 is determined such that a portion of gas-liquid mixed phase refrigerant having flowed into the first header tank 3; i.e., liquid-predominant mixed phase refrigerant, remains in a lower region within the first header tank 3 because of gravitational force, and the gas phase component of the gas-liquid mixed phase refrigerant remains in an upper region within the first header tank 3 because of gravitational force, whereby only the liquid-predominant mixed phase refrigerant flows into the first heat exchange tubes 2A of the fourth heat exchange path P4.

The third header tank 5 is disposed at the right end of the condenser 1, and all the heat exchange tubes 2A, 2B which form the first to fourth heat exchange paths P1-P4 are connected to the third header tank 5. The transverse cross sectional shape of the third header tank 5 is identical with that of the second header tank 4. The interior of the third header tank 5 is divided into an upper header section 11, an intermediate header section 12, and a lower header section 13 by aluminum partition plates 8, 9, which are provided at a height between the first heat exchange path P1 and the second heat exchange path P2 and a height between the third heat exchange path P3 and the fourth heat exchange path P4, respectively. Left end portions of the second heat exchange tubes 2B of the first heat exchange path P1 are connected to the second header tank 4, and right end portions thereof are connected to the upper header section 11 of the third header tank 5. Left end portions of the second heat exchange tubes 2B of the second heat exchange path P2 are connected to the second header tank 4, and right end portions thereof are connected to the intermediate header section 12 of the third header tank 5. Left end portions of the first heat exchange tubes 2A of the third heat exchange path P3 are connected to the first header tank 3, and right end portions thereof are connected to the intermediate header section 12 of the third header tank 5. Left end portions of the first heat exchange tubes 2A of the fourth heat exchange path P4 are connected to the first header tank 3, and right end portions thereof are connected to the lower header section 13 of the third header tank 5.

The second header tank 4, a portion of the first header tank 3 to which the first heat exchange tubes 2A of the third heat exchange path P3 are connected, the upper and intermediate header sections 11 and 12 of the third header tank 5, and the first to third heat exchange paths P1-P3 form a condensation section 1A, which condenses refrigerant. A portion of the first header tank 3 to which the first heat exchange tubes 2A of the fourth heat exchange path P4 are connected, the lower header section 13 of the third header tank 5, and the fourth heat exchange path P4 form a super-cooling section 1B, which super-cools refrigerant. Each of the first to third heat exchange paths P1-P3 serves as a refrigerant condensation path for condensing refrigerant, and the fourth heat exchange path P4 serves as a refrigerant super-cooling path for super-cooling refrigerant.

A refrigerant inlet 14 is formed at the upper header section 11 of the third header tank 5, which partially forms the condensation section 1A, and a refrigerant outlet 15 is formed at the lower header section 13 of the third header tank 5, which partially forms the super-cooling section 1B. A refrigerant inlet member 16 which communicates with the refrigerant inlet 14 and a refrigerant outlet member 17 which communicates with the refrigerant outlet 15 are joined to the third header tank 5.

An intermediate member 18 formed of aluminum and extending in the left-right direction is disposed between the upper end first heat exchange tube 2A of the third heat exchange path P3 and the lower end second heat exchange tube 2B of the second heat exchange path P2 such that the intermediate member 18 is separated from these heat exchange tubes 2A, 2B and becomes substantially parallel to the heat exchange tubes 2A, 2B. A first corrugate fin 6A is disposed between the upper end first heat exchange tube 2A of the third heat exchange path P3 and the intermediate member 18, and is brazed to the first heat exchange tube 2A and the intermediate member 18. A second corrugate fin 6B is disposed between the lower end second heat exchange tube 2B of the second heat exchange path P2 and the intermediate member 18, and is brazed to the second heat exchange tube 2B and the intermediate member 18. The left and right end portions of the intermediate member 18 are located near the first header tank 3 and the third header tank 5, and are not inserted into the first header tank 3 and the third header tank 5. A tube having the same structure as the second heat exchange tubes 2B is used as the intermediate member 18. Since opposite end portions of the intermediate member 18 are not inserted into the first header tank 3 and the third header tank 5, use of a tube having the same structure as the second heat exchange tubes 2B becomes possible.

Opposite end portions of the side plates 7 are brazed to the second header tank 4 and the third header tank 5 in a state in which the opposite ends of the side plates 7 are inserted into the second header tank 4 and the third header tank 5. Cutouts 19, which open toward the front side, are formed in the side plates 7 at positions near the ends thereof located on the side toward the second header tank (see FIG. 3).

As shown in FIGS. 3 and 4, the first heat exchange tubes 2A connected to the first header tank 3, the second heat exchange tubes 2B connected to the second header tank 4, the side plates 7, and the intermediate member 18 are bent in the same direction (in the present embodiment, bent rearward) at a position near the first header tank 3 and the second header tank 4; i.e., about a common vertical line O present within the cutouts 19 of the side plates 7. A bent portion 2*a*, 2*b*, 7*a*, 18*a* of each of the first heat exchange tubes 2A, the second heat exchange tubes 2B, the side plates 7, and the intermediate member 18 is located in the same horizontal plane as the remaining unbent portion. Left end portions of the first corrugate fins 6A—which are disposed between the adjacent first heat exchange tubes 2A and between the upper end first heat exchange tube 2A and the intermediate member 18—exist between the bent portions 2*a* of the adjacent first heat exchange tubes 2A and between the bent portion 2*a* of the upper end first heat exchange tube 2A and the bent portion 18*a* of the intermediate member 18. Similarly, left end portions of the second corrugate fins 6B—which are disposed between the adjacent second heat exchange tubes 2B and between the lower end second heat exchange tube 2B and the intermediate member 18—exist between the bent portions 2*b* of the adjacent second heat exchange tubes 2B and between the bent portion 2*b* of the lower end second heat exchange tube 2B and the bent portion 18*a* of the intermediate member 18.

The condenser 1 is manufactured as follows.

First, straight first and second heat exchange tubes 2A, 2B and straight side plates 7 having cutouts 19 are prepared, and all components including these are brazed together to thereby manufacture a semi-finished condenser product 20. As shown in FIG. 5, in this semi-finished condenser product 20, the first heat exchange tubes 2A, the second heat exchange tubes 2B, and the side plates 7 having the cutouts 19 are straight. Further, the cutouts 19 of the side plates 7 are not expanded; i.e., opposite side walls of each cutout 19 are parallel. After that, the semi-finished condenser product 20; that is, the first heat exchange tubes 2A, the second heat exchange tubes 2B, the side plates 7, the intermediate member 18, the first corrugate fins 6A, and the second corrugate fins 6B, are bent rearward about the common vertical line O present within the cutouts 19 of the side plates. Thus, the condenser 1 is manufactured.

The condenser 1 constitutes a refrigeration cycle in cooperation with a compressor, an expansion valve (pressure reducer), and an evaporator; and the refrigeration cycle is mounted on a vehicle as a car air conditioner. At that time, as indicated by chain lines in FIGS. 3 and 4, in general, a radiator R is disposed on the downstream side of the condenser 1 with respect to the air passage direction. Even in such a case, the first header tank 3 and the second header tank 4 do not hinder installation of the radiator R, and a wasteful space is not produced in the engine compartment, because the first header tank 3 is disposed on the outer side of the second header tank 4 with respect to the left-right direction such that the first tank 3 is offset from the second header tank 4 in the air passage direction, and the first heat exchange tubes 2A, the second heat exchange tubes 2B, the side plates 7, and the intermediate member 18 are bent in the same direction about the common vertical line O.

In the condenser 1 having the above-described structure, gas phase refrigerant of high temperature and high pressure compressed by the compressor flows into the upper header section 11 of the third header tank 5 via the refrigerant inlet member 16 and the refrigerant inlet 14. The gas phase refrigerant is condensed while flowing leftward within the second heat exchange tubes 2B of the first heat exchange path P1, and then flows into the second header tank 4. The refrigerant having flowed into the second header tank 4 is condensed while flowing rightward within the second heat exchange tubes 2B of the second heat exchange path P2, and then flows into the intermediate header section 12 of the third header tank 5. The refrigerant having flowed into the intermediate header section 12 of the third header tank 5 is condensed while flowing leftward within the first heat exchange tubes 2A of the third heat exchange path P3, and then flows into the first header tank 3.

The refrigerant having flowed into the first header tank 3 is gas-liquid mixed phase refrigerant. A portion of the gas-liquid mixed phase refrigerant; i.e., liquid-predominant mixed phase refrigerant, remains in a lower region within the first header tank 3 because of gravitational force, and enters the first heat exchange tubes 2A of the fourth heat exchange path P4.

The liquid-predominant mixed phase refrigerant having entered the first heat exchange tubes 2A of the fourth heat exchange path P4 is super-cooled while flowing rightward within the first heat exchange tubes 2A. After that, the super-cooled refrigerant enters the lower header section 13 of the third header tank 5, and flows out via the refrigerant outlet 15 and the refrigerant outlet member 17. The refrigerant is then fed to the evaporator via the expansion valve.

Meanwhile, the gas phase component of the gas-liquid mixed phase refrigerant having flowed into the first header tank 3 remains in an upper region within the first header tank 3.

Figure 6:
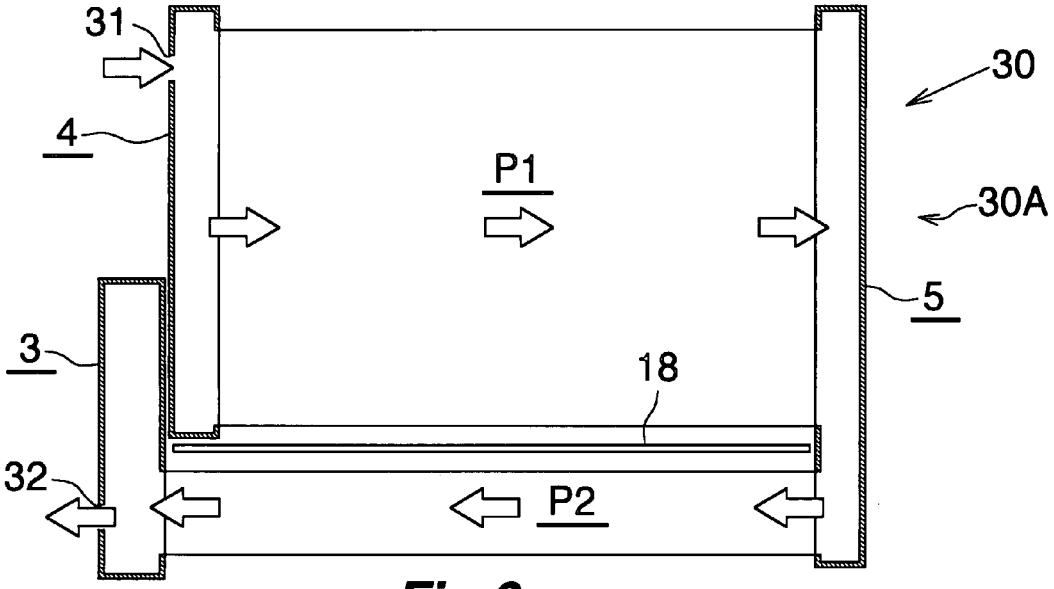
FIG. 6 is a front view schematically showing a second embodiment of the condenser according to the present invention.
Figure 7:
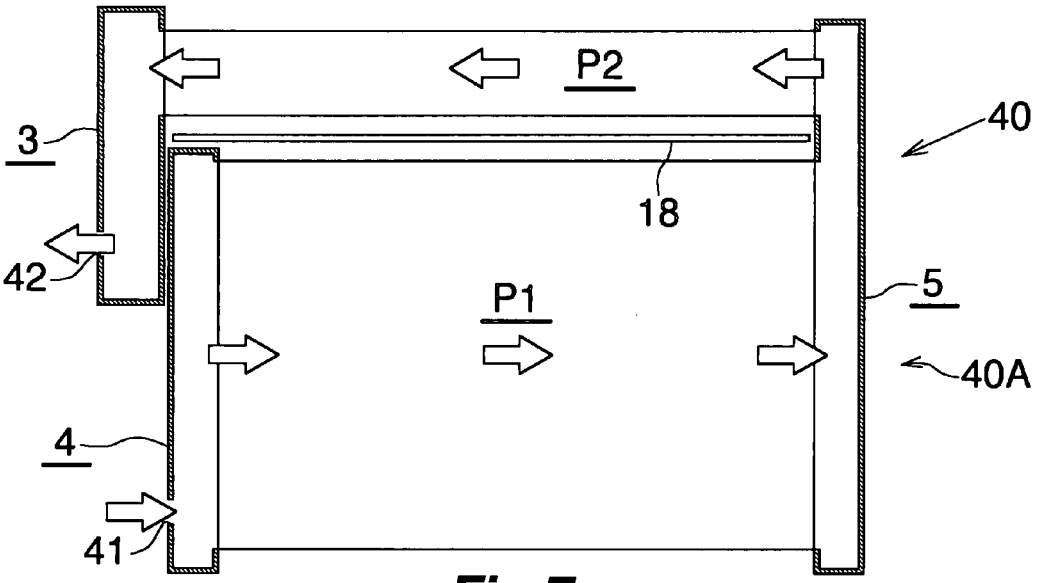
FIG. 7 is a front view schematically showing a third embodiment of the condenser according to the present invention.

FIGS. 6 and 7 show other embodiments of the condenser according to the present invention. Notably, in FIGS. 6 and 7, which schematically show the condenser, the individual heat exchange tubes are omitted, and the corrugate fins, the side plates, the refrigerant inlet member, and the refrigerant outlet member are also omitted.

In the case of a condenser 30 shown in FIG. 6, two heat exchange paths P1, P2 each formed by a plurality of heat exchange tubes 2A, 2B successively arranged in the vertical direction are juxtaposed in the vertical direction. The two heat exchange paths will be referred to as the first and second heat exchange paths P1, P2 from the upper side. The flow direction of refrigerant is the same among all the heat exchange tubes 2A, 2B which form the respective heat exchange paths P1, P2. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path.

Left and right end portions of the heat exchange tubes 2B, which form the first heat exchange path P1, are connected to the second header tank 4 and the third header tank 5, respectively, by means of brazing. Left and right end portions of the heat exchange tubes 2A, which form the second heat exchange path P2, are connected to the first header tank 3 and the third header tank 5, respectively, by means of brazing. Therefore, the heat exchange tubes 2A, which form the second heat exchange path P2, are the first heat exchange tubes, and the heat exchange tubes 2B, which form the first heat exchange path P1, are the second heat exchange tubes.

The first through third header tank 3-5, and the first and second heat exchange paths P1, P2 form a condensation section 30A, which condenses refrigerant. The first and second heat exchange paths P1, P2 (i.e., all the heat exchange paths) each serve as a refrigerant condensation path for condensing refrigerant.

A refrigerant inlet 31 is formed at an upper end portion of the second header tank 4, which partially forms the condensation section 30A, and a refrigerant outlet 32 is formed at a lower end portion of the first header tank 3, which partially forms the condensation section 30A. A refrigerant inlet member (not shown) which communicates with the refrigerant inlet 31 is joined to the second header tank 4, and a refrigerant outlet member (not shown) which communicates with the refrigerant outlet 32 is joined to the first header tank 3.

In the condenser 30 shown in FIG. 6, an intermediate member 18 extending in the left-right direction is disposed between the upper end first heat exchange tube 2A of the second heat exchange path P2 and the lower end second heat exchange tube 2B of the first heat exchange path P1 such that the intermediate member 18 is separated from these heat exchange tubes 2A, 2B and becomes substantially parallel to the heat exchange tubes 2A, 2B. Although not illustrated, a first corrugate fin 6A is disposed between the upper end first heat exchange tube 2A of the second heat exchange path P2 and the intermediate member 18, and is brazed to the first heat exchange tube 2A and the intermediate member 18. A second corrugate fin 6B is disposed between the lower end second heat exchange tube 2B of the first heat exchange path P1 and the intermediate member 18, and is brazed to the second heat exchange tube 2B and the intermediate member 18.

The remaining structure is similar to that of the condenser shown in FIGS. 1 to 4.

In the condenser 30 shown in FIG. 6, gas phase refrigerant of high temperature and high pressure compressed by the compressor flows into the second header tank 4 via the refrigerant inlet member and the refrigerant inlet 31. The gas phase refrigerant is condensed while flowing rightward within the second heat exchange tubes 2B of the first heat exchange path P1, and then flows into the third header tank 5. The refrigerant having flowed into the third header tank 5 is condensed while flowing leftward within the first heat exchange tubes 2A of the second heat exchange path P2, and then flows into the first header tank 3.

The refrigerant having flowed into the first header tank 3 is gas-liquid mixed phase refrigerant. A portion of the gas-liquid mixed phase refrigerant; i.e., liquid-predominant mixed phase refrigerant, remains in a lower region within the first header tank 3 because of gravitational force, and flows out via the refrigerant outlet 32 and the refrigerant outlet member. The refrigerant is then fed to the evaporator via the expansion valve.

Meanwhile, the gas phase component of the gas-liquid mixed phase refrigerant having flowed into the first header tank 3 remains in an upper region within the first header tank 3.

In the case of a condenser 40 shown in FIG. 7, two heat exchange paths P1, P2 each formed by a plurality of heat exchange tubes 2A, 2B successively arranged in the vertical direction are juxtaposed in the vertical direction. The two heat exchange paths will be referred to as the first and second heat exchange paths P1, P2 from the lower side. The flow direction of refrigerant is the same among all the heat exchange tubes 2A, 2B which form the respective heat exchange paths P1, P2. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path.

The lower end of the first header tank 3 is located below the upper end of the second header tank 4, and the first header tank 3 has a gas-liquid separation function.

Left and right end portions of the heat exchange tubes 2B, which form the first heat exchange path P1, are connected to the second header tank 4 and the third header tank 5, respectively, by means of brazing. Left and right end portions of the heat exchange tubes 2A, which form the second heat exchange path P2, are connected to the first header tank 3 and the third header tank 5, respectively, by means of brazing. Therefore, the heat exchange tubes 2A, which form the second heat exchange path P2, are the first heat exchange tubes, and the heat exchange tubes 2B, which form the first heat exchange path P1, are the second heat exchange tubes.

The first through third header tank 3-5, and the first and second heat exchange paths P1, P2 form a condensation section 40A, which condenses refrigerant. The first and second heat exchange paths P1, P2 (i.e., all the heat exchange paths) each serve as a refrigerant condensation path for condensing refrigerant.

A refrigerant inlet 41 is formed at a lower end portion of the second header tank 4, which partially forms the condensation section 40A, and a refrigerant outlet 42 is formed at a lower end portion of the first header tank 3, which partially forms the condensation section 40A. A refrigerant inlet member (not shown) which communicates with the refrigerant inlet 41 is joined to the second header tank 4, and a refrigerant outlet member (not shown) which communicates with the refrigerant outlet 42 is joined to the first header tank 3.

In the condenser 40 shown in FIG. 7, an intermediate member 18 extending in the left-right direction is disposed between the lower end first heat exchange tube 2A of the second heat exchange path P2 and the upper end second heat exchange tube 2B of the first heat exchange path P1 such that the intermediate member 18 is separated from these heat exchange tubes 2A, 2B and becomes substantially parallel to the heat exchange tubes 2A, 2B. Although not illustrated, a first corrugate fin 6A is disposed between the lower end first heat exchange tube 2A of the second heat exchange path P2 and the intermediate member 18, and is brazed to the first heat exchange tube 2A and the intermediate member 18. A second corrugate fin 6B is disposed between the upper end second heat exchange tube 2B of the first heat exchange path P1 and the intermediate member 18, and is brazed to the second heat exchange tube 2B and the intermediate member 18.

The remaining structure is similar to that of the condenser shown in FIGS. 1 to 4.

In the condenser 40 shown in FIG. 7, gas phase refrigerant of high temperature and high pressure compressed by the compressor flows into the second header tank 4 via the refrigerant inlet member and the refrigerant inlet 41. The gas phase refrigerant is condensed while flowing rightward within the second heat exchange tubes 2B of the first heat exchange path P1, and then flows into the third header tank 5. The refrigerant having flowed into the third header tank 5 is condensed while flowing leftward within the first heat exchange tubes 2A of the second heat exchange path P2, and then flows into the first header tank 3. The refrigerant having flowed into the first header tank 3 is gas-liquid mixed phase refrigerant. A portion of the gas-liquid mixed phase refrigerant; i.e., liquid-predominant mixed phase refrigerant, remains in a lower region within the first header tank 3 because of gravitational force, and flows out via the refrigerant outlet 42 and the refrigerant outlet member. The refrigerant is then fed to the evaporator via the expansion valve.

Meanwhile, the gas phase component of the gas-liquid mixed phase refrigerant having flowed into the first header tank 3 remains in an upper region within the first header tank 3.

Although not illustrated, in the condensers 30, 40 shown in FIGS. 6 and 7, the first heat exchange tubes 2A connected to the first header tank 3, the second heat exchange tubes 2B connected to the second header tank 4, the side plates 7, the intermediate member 18, the first corrugate fins 6A, and the second corrugate fins 6B are bent in the same direction (in the present embodiment, bent rearward) at a position near the first header tank 3 and the second header tank 4; i.e., about a common vertical line present within the cutouts 19 of the side plates 7. A bent portion of each of the first heat exchange tubes 2A, the second heat exchange tubes 2B, the side plates 7, and the intermediate member 18 is located in the same horizontal plane as the remaining unbent portion.

Notably, in the condensers 30, 40 shown in FIGS. 6 and 7, two or more heat exchange paths each formed by a plurality of second heat exchange tubes 2B successively arranged in the vertical direction may be juxtaposed in the vertical direction between the second header tank 4 and the third header tank 5. In the case where an even number of heat exchange paths are provided between the second header tank 4 and the third header tank 5, a refrigerant inlet is formed at a lower end portion of the third header tank 5, and a proper number of header sections are provided in each of the second header tank 4 and the third header tank 5. In the case where an odd number of heat exchange paths are provided between the second header tank 4 and the third header tank 5, a refrigerant inlet is formed at a lower end portion of the second header tank 4, and a proper number of header sections are provided in each of the second header tank 4 and the third header tank 5.

Notably, in each of the above-described condensers 1, 20, 30, at least one of a desiccant, a gas liquid separation member, and a filter may be disposed in the first header tank 3.

The condenser according to the present invention is suitable for use in a car air conditioner mounted on an automobile.

What is claimed is:

1. A condenser comprising a plurality of heat exchange tubes disposed in parallel such that the heat exchange tubes are spaced apart from one another in a vertical direction and extend in a left-right direction; header tanks which extend in the vertical direction and to which left and right end portions of the heat exchange tubes are connected; and fins each disposed between heat exchange tubes adjacent to each other in the vertical direction, in which three or more heat exchange paths each formed by a plurality of heat exchange tubes successively arranged in the vertical direction are juxtaposed in the vertical direction, refrigerant flows in the same direction in all the heat exchange tubes which form each heat exchange path, and the flow direction of refrigerant in the heat exchange tubes which form a certain heat exchange path is opposite the flow direction of refrigerant in the heat exchange tubes which form another heat exchange path adjacent to the certain heat exchange path, wherein first and second header tanks are provided at a left or right end of the condenser, first heat exchange tubes which form at least two heat exchange paths successively arranged and including a heat exchange path at a lower end of the condenser being connected to the first header tank, and second heat exchange tubes which form a heat exchange path(s) provided above the heat exchange paths formed by the first heat exchange tubes connected to the first header tank being connected to the second header tank;

the first header tank is disposed on the outer side of the second header tank with respect to the left-right direction, has an upper end located above a lower end of the second header tank, and has a function of separating gas and liquid from each other by making use of gravitational force and storing the liquid;

the first header tank is disposed at a position offset from the second header tank with respect to an air passage direction as viewed from above; and the first heat exchange tubes connected to the first header tank and the second heat exchange tubes connected to the second header tank are bent in the same direction about a common vertical line, wherein: a fin is disposed on the outer side of each of the heat exchange tubes located at the upper and lower ends and is brazed to the corresponding heat exchange tube, a side plate is disposed on the outer side of each of the fins located at the upper and lower ends and is brazed to the corresponding fin, and the side plates are bent in the same direction as the first and second heat exchange tubes about the common vertical line about which the first and second heat exchange tubes are bent; and a cutout which opens toward a direction opposite the bending direction of the side plates is formed in each side plate at a position near the end thereof located toward the first and second header tanks, and the vertical line about which the first and second heat exchange tubes and the side plates are bent is located within the cutouts of the side plates.

2. A condenser according to claim 1, wherein an upper end heat exchange path of the heat exchange paths formed by the first heat exchange tubes connected to the first header tank and the heat exchange path(s) formed by the second heat exchange tubes connected to the second header each serve as a refrigerant condensation path for condensing refrigerant, and the heat exchange paths formed by the first heat exchange tubes connected to the first header tank, excluding the upper end heat exchange path, each serves as a refrigerant supper-cooling path for supper-cooling refrigerant.

3. A condenser according to claim 1, wherein the first heat exchange tubes which form at least two heat exchange paths are connected to the first header tank, and the second heat exchange tubes which form at least one heat exchange path are connected to the second header tank.

4. A method for manufacturing a condenser according to claim 1, characterized in that, after the first header tank, the second header tank, the first heat exchange tubes, the second heat exchange tubes, and the fins are brazed together, the first heat exchange tubes connected to the first header tank and the second heat exchange tubes connected to the second header tank are bent in the same direction about the common vertical line.

5. A method for manufacturing a condenser according to claim 1, characterized in that, after the first header tank, the second header tank, the first heat exchange tubes, the second heat exchange tubes, the fins, and the side plates are brazed together, the first heat exchange tubes connected to the first header tank, the second heat exchange tubes connected to the second header tank, and the side plates are bent in the same direction about the common vertical line.

6. A method for manufacturing a condenser according to claim 1, characterized in that a cutout which opens toward a direction opposite a direction in which the side plates are to be bent is formed in each side plate at a position near the end thereof which is to be connected to the first or second header tank; and, after the first header tank, the second header tank, the first heat exchange tubes, the second heat exchange tubes, the fins, and the side plates are brazed together, the first heat exchange tubes connected to the first header tank, the second heat exchange tubes connected to the second header tank, and the side plates are bent, about a common vertical line located within the cutouts of the side plates, in a direction opposite the direction toward which the openings of the side plates open.

* * * * *